US005912551A

United States Patent [19]

Corsi et al.

[11] Patent Number: 5,912,551

[45] Date of Patent: Jun. 15, 1999

[54] START UP CIRCUIT FOR A BOOST MODE CONTROLLER

[75] Inventors: Marco Corsi; Neil Gibson, both of Plano, Tex.

[73] Assignee: Texas Instruments Incorporated, Dallas, Tex.

[21] Appl. No.: 09/063,653

[22] Filed: Apr. 21, 1998

Related U.S. Application Data

[ 60] Provisional application No. 60/044,512, Apr. 21, 1997.

[51] Int. Cl.[6] ..... G05F 1/563

[52] U.S. Cl. ..... 323/283; 323/222

[58] Field of Search ..... 323/222, 282, 323/283, 284, 285, 351

[56] References Cited

U.S. PATENT DOCUMENTS 5,612,610 3/1997 Borghi et al. ..... 323/222

5,629,610 5/1997 Pedrazzini et al. ..... 323/283

*Primary Examiner*—Robert E. Nappi

*Assistant Examiner*—Y. J. Han

*Attorney, Agent, or Firm*—Alan K. Stewart; Wade James Brady, III; Richard L. Donaldson

[57] ABSTRACT

A boost mode controller with start up circuit includes: an inductor 12; a transistor 10 coupled to a first end of the inductor 12; a diode 16 having an anode coupled to the first end of the inductor 12; a capacitor 14 coupled to a cathode of the diode 16; a logic circuit 22 having an output coupled to a control node of the transistor 10; a comparator 28 having an output coupled to a first input of the logic circuit 22, a first input of the comparator 28 coupled to the capacitor 14, and a second input of the comparator 28 coupled to a reference node; and a counter 20 having an active low reset coupled to the output of the comparator 28 and an output coupled to a second input of the logic circuit 22.

7 Claims, 1 Drawing Sheet

START UP CIRCUIT FOR A BOOST MODE CONTROLLER

This application claims priority under 35 USC § 119 (e) (1) of provisional application No. 60/044,512, filed Apr. 21, 1997.

FIELD OF THE INVENTION

This invention generally relates to electronic systems and in particular it relates to boost mode controller circuits.

BACKGROUND OF THE INVENTION

A boost mode controller circuit includes a transistor coupled in series with an inductor and a capacitor coupled to the inductor through a diode. The output voltage of the circuit is the voltage on the capacitor. When the boost mode controller starts up, its output is at zero volts and thus the controller's feedback system will assume that more energy is required from the power supply and will thus turn on the transistor. This in turn causes a build up of current in the inductor. This in itself will not cause the output voltage to rise, as the inductor's energy is only transferred to the capacitor when the transistor is turned off. The consequence of this is that the current continues to build up in the inductor until something breaks.

SUMMARY OF THE INVENTION

Generally, and in one form of the invention, the boost mode controller with start up circuit includes: an inductor; a transistor coupled to a first end of the inductor; a diode having an anode coupled to the first end of the inductor; a capacitor coupled to a cathode of the diode; a logic circuit having an output coupled to a control node of the transistor; a comparator having an output coupled to a first input of the logic circuit, a first input of the comparator coupled to the capacitor, and a second input of the comparator coupled to a reference node; and a counter having an active low reset coupled to the output of the comparator and an output coupled to a second input of the logic circuit.

DETAILED DESCRIPTION OF PREFERRED EMBODIMENTS

Figure 1:
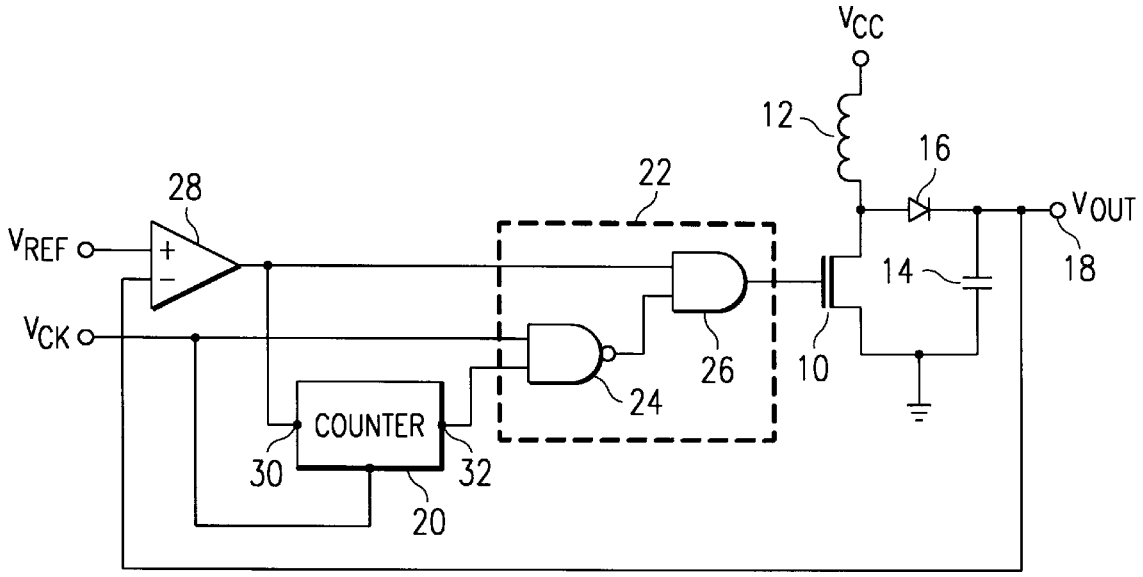
FIG. 1 is a schematic circuit diagram of a preferred embodiment boost mode controller with start up circuit.

FIG. 1 is a circuit schematic illustrating a preferred embodiment boost mode controller with start up circuit constructed according to the teachings of the present invention. The circuit of FIG. 2 includes NMOS transistor 10; inductor 12; capacitor 14; diode 16; output node 18; counter 20; logic circuit 22 which includes "nand" gate 24 and "and" gate 26; comparator 28; source voltage $V_{CC}$; reference signal $V_{REF}$; output voltage $V_{OUT}$; and clock signal $V_{CK}$. In the preferred embodiment, reference signal $V_{REF}$ is a ramp signal at a frequency of 256 KHz with a voltage range from 1.5 volts to 2.5 volts. The comparator 28 provides a pulse width modulated signal when $V_{OUT}$ varies between 1.5 volts and 2.5 volts. The comparator 28 provides a high output (logic "one") when $V_{OUT}$ is less than 1.5 volts and a low output (logic "zero") when $V_{OUT}$ is greater than 2.5 volts.

Clock signal $V_{CK}$ controls the clocking of counter 28 and, in the preferred embodiment, has a frequency of one half the frequency of the reference signal $V_{REF}$.

When power is applied to the circuit of FIG. 1, output voltage $V_{OUT}$ is less than the desired voltage and the comparator's output $V_{COM}$ is a logic "one". The output of the comparator 28 is coupled to "and" gate 26 and the active low reset node 30 of counter 20. The "one" from the comparator 28 releases the reset of the counter 20. Until the counter 20 reaches the designated count (two in the preferred embodiment), the counter output at node 32 is a logic "zero". While the counter 20 output is "zero", the nand gate 24 output is "one". Then the output of "and" gate 26 is "one" which turns transistor 10 on and builds current up in inductor 12. When the counter 20 detects the designated count, the counter 20 outputs a "one" to "nand" gate 24. This allows the clock signal $V_{CK}$ to pass through "nand" gate 24 and "and" gate 26. The clock signal $V_{CK}$ then switches transistor 10 on and off. Then current from the inductor 12 is transferred to capacitor 14 which raises output voltage $V_{OUT}$. Clock signal $V_{CK}$ continues to switch transistor 10 on and off until the output voltage $V_{OUT}$ is in range of $V_{REF}$. Then the comparator 28 starts to provide a pulse signal and resets the counter 20. The output of the counter 20 will then switch to "zero" and prevent the clock signal $V_{CK}$ from switching transistor 10 on and off. The boost controller circuit of FIG. 1 is then in its normal operating state with the output of comparator 28 switching transistor 10 on and off. If the output voltage $V_{OUT}$ goes too high and out of range of $V_{REF}$, the comparator output $V_{COM}$ will be a "zero" and transistor 10 is turned off. If the output voltage $V_{OUT}$ goes too low, such as for a short circuit, then the start up procedure is repeated.

Figure 2:
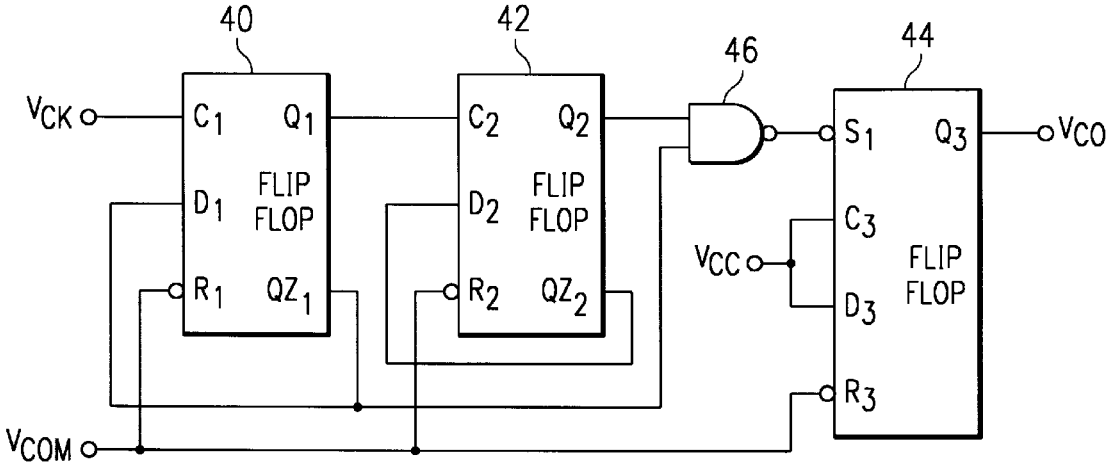
FIG. 2 is a schematic circuit diagram of the counter shown in FIG. 1.

FIG. 2 is a preferred embodiment implementation of the counter 20 in FIG. 1. The counter circuit of FIG. 2 includes "D" flip flops 40, 42, and 44; nand gate 46; $V_{COM}$; $V_{CK}$; $V_{CO}$; and $V_{CC}$. $D_1$, $D_2$, and $D_3$ are the inputs of flip flops 40, 42, and 44. $R_1$, $R_2$, and $R_3$ are the active low reset nodes of flip flops 40, 42, and 44. $C_1$, $C_2$, and $C_3$ are the clock nodes of flip flops 40, 42, and 44. $Q_1$, $Q_2$, and $Q_3$ are the non-inverted outputs of flip flops 40, 42, and 44. $QZ_1$ and $QZ_2$ are the inverted outputs of flip flops 40 and 42. $S_1$ is the preset node of flip flop 44.

When $V_{COM}$ is a logic "one", the clear is released on the flip flops 40, 42, and 44 of FIG. 2 and the counter starts counting the clock pulses in $V_{CK}$. Until the counter of FIG. 2 reaches a count of two, the counter output $V_{CO}$ is a logic "zero". When the counter reaches a count of two, the counter stops counting and the counter output $V_{CO}$ is a logic "one". The counter output $V_{CO}$ then remains a logic "one" until $V_{COM}$ is a logic "zero". When $V_{COM}$ is a logic "zero", the flip flops 40, 42, and 44 are cleared and the counter output $V_{CO}$ returns to a logic "zero".

Although the present invention has been described in detail, it should be understood that various changes, substitutions and alterations can be made without departing from the spirit and scope of the invention as defined by the appended claims. It is therefore intended that the appended claims encompass any such modifications or embodiments.

What is claimed is:

1. A boost mode controller with start up circuit comprising:

an inductor;

a transistor coupled to a first end of the inductor;

a diode having an anode coupled to the first end of the inductor;

a capacitor coupled to a cathode of the diode;

a logic circuit having an output coupled to a control node of the transistor;

a comparator having an output coupled to a first input of the logic circuit, a first input of the comparator coupled to the capacitor, and a second input of the comparator coupled to a reference node; and a counter having an active low reset coupled to the output of the comparator and an output coupled to a second input of the logic circuit.

2. The circuit of claim 1 wherein the logic circuit comprises:

a Nand gate having a first input coupled to the output of the counter and a second input coupled to a clock node; and an And gate having a first input coupled to an output of the Nand gate, a second input coupled to the output of the comparator, and an output coupled to the control node of the transistor.

3. The circuit of claim 1 wherein the counter comprises:

a first D flip flop having an active low reset coupled to the comparator output;

a second D flip flop having an active low reset coupled to the comparator output and a clock input coupled to a non-inverting output of the first D flip flop;

a Nand gate having a first input coupled to a non-inverting output of the second D flip flop and a second input coupled to an inverting output of the first D flip flop;

a third D flip flop having an active low reset coupled to the comparator output and a preset input coupled to an output of the Nand gate, a non-inverting output of the third D flip flop is the output of the counter.

4. The circuit of claim 1 wherein a ramp signal is applied at the reference node.

5. The circuit of claim 1 further comprising a clock node coupled to a third input of the logic circuit.

6. The circuit of claim 1 wherein the transistor is a MOS transistor.

7. The circuit of claim 1 wherein the transistor is an NMOS transistor.

* * * * *